United States Patent [19]

Miasek et al.

[11] 4,147,611

[45] Apr. 3, 1979

[54] REGENERATION OF ALKALI METAL SULFIDES FROM ALKALI METAL HYDROSULFIDES

[75] Inventors: Peter G. Miasek; John J. Dugan, both of Sarnia, Canada

[73] Assignee: Imperial Oil Enterprises Ltd., Toronto, Canada

[21] Appl. No.: 876,898

[22] Filed: Feb. 13, 1978

[51] Int. Cl.[2] ..... C10G 13/06; C01B 17/26

[52] U.S. Cl. ..... 208/108; 208/209; 208/235; 252/436; 423/561 A; 423/563; 423/572

[58] Field of Search ..... 208/108; 423/561 A, 423/563, 572, DIG. 3

[56] References Cited

U.S. PATENT DOCUMENTS 2,106,952 2/1938 Konig ..... 423/561 A 4,119,528 10/1978 Baird et al. ..... 208/108

*Primary Examiner*—Delbert E. Gantz
*Assistant Examiner*—G. E. Schmitkons
*Attorney, Agent, or Firm*—Marthe L. Gibbons

[57] ABSTRACT

Alkali metal sulfides are regenerated from alkali metal hydrosulfides which are produced as a result of the hydroconversion of heavy carbonaceous feeds. The regeneration is effected by treating the spent solids from a hydroconversion reactor, said solids containing an alkali metal hydrosulfide, with water and carbon dioxide at a temperature and pressure sufficient to convert about 50% of the alkali metal hydrosulfide to an alkali metal carbonate, and heating a mixture of said alkali metal carbonate and unreacted alkali metal hydrosulfide with a quantity of coke to an elevated temperature sufficient to cause reaction of the hydrosulfide with the carbonate whereby an alkali metal sulfide is formed.

19 Claims, No Drawings

REGENERATION OF ALKALI METAL SULFIDES FROM ALKALI METAL HYDROSULFIDES

FIELD OF THE INVENTION

The present invention relates to the regeneration of an alkali metal sulfide from an alkali metal hydrosulfide, the former being an active reagent for the hydroconversion of sulfur-containing hydrocarbon feedstocks. More particularly, the present invention relates to the regeneration of an alkali metal sulfide from an alkali metal hydrosulfide by treatment of the hydrosulfide contained in the spent solids from a hydroconversion reactor. Still more particularly, the invention relates to the regeneration of an alkali metal sulfide, wherein said alkali metal sulfide can be recycled to a hydroconversion reactor for further use therein.

DESCRIPTION OF THE PRIOR ART

Conversion of heavy hydrocarbon feeds to more valuable distillate products, such as gasoline, naphtha, fuel oil and heating oil, by contacting such feeds in the presence of high pressure hydrogen with alkali metal sulfides is known. During the hydroconversion process, the alkali metal sulfide reacts with organically bound sulfur, or with hydrogen sulfide liberated thermally, to produce an alkali metal hydrosulfide which is inactive for hydroconversion. Heretofore, the formation or regeneration of the alkali metal sulfide from an alkali metal hydrosulfide was accomplished by reaction of the hydrosulfide with an alkali metal hydroxide.

The disadvantage to this method is that the source of the reactant results in a considerable expense, and is not economically feasible. Further, in some instances it is necessary to separate any alkali metal hydrosulfide from the other materials, particularly coke, found in the spent solids coming from the hydroconversion reactor. Therefore, an economical process whereby the alkali metal sulfide could be regenerated from the alkali metal hydrosulfide directly from the spent solids of the hydroconversion reactor, and by using reactants which are inexpensive and relatively easy to obtain, has been sought.

An alternate to the method disclosed herein is described in co-pending application Ser. No. 876,904, assigned to Exxon Research and Engineering Company, the assignee of this application, wherein regeneration of alkali metal sulfides from alkali metal hydrosulfides by contact of the hydrosulfide with a metal oxide at elevated temperatures is disclosed.

SUMMARY OF THE INVENTION

In accordance with this invention, an efficient and inexpensive conversion of an alkali metal hydrosulfide to an alkali metal sulfide is presented, wherein the alkali metal hydrosulfide contained in the spent solids of a hydroconversion reactor in which hydroconversion has been effected by contact of the feed with an alkali metal sulfide, is contacted with water and carbon dioxide under specific conditions to thereby convert roughly half of the hydrosulfide to an alkali metal carbonate. The product from this reaction, which comprises a mixture of alkali metal carbonate, unreacted alkali metal hydrosulfide, together with coke produced during the hydroconversion reaction, is heated to elevated temperatures at roughly atmospheric pressure to thereby produce the alkali metal sulfide.

The carbonation reaction can be effected by reaction of the spent solids in the form of a melt or slurry at elevated temperatures with a mixture of carbon dioxide and steam, or at much milder temperatures by first dissolving the spent solids in water and treating with carbon dioxide. The reaction product from the carbonation step when heated in the presence of coke, the coke being derived from the spent solids of a hydroconversion reactor or from another source, results in the formation of the alkali metal sulfide.

It is another feature of this invention that the level of metal including Ni, V, and Fe originally present in the petroleum fraction and remaining in the alkali metal sulfide produced can be controlled, if desired, by a small slipstream, where a portion of the spent solids from the hydroconversion reactor is dissolved in water. The salts of certain of the metals are insoluble in water and can thus be easily separated from the soluble alkali metal sulfides. Alternatively, if aqueous solution carbonation is used, part of the solution to or from the carbonation reactor can be filtered directly to remove these metals.

The alkali metal sulfides which may be employed in the present invention generally include the sulfides of those metals contained in Group I-A of the Periodic Table of Elements. Specifically, it has been found that the sulfides of lithium, sodium, potassium, rubidium, and cesium are particularly useful in this process. The preferred sulfide is potassium sulfide due to its ready availability as well as the ease with which it may be recovered and regenerated for further use.

DETAILED DESCRIPTION

The spent solids from the hydroconversion reactor are removed to a carbonation chamber wherein the carbonation reaction is to be effected. The spent solids comprise primarily alkali metal hydrosulfides, coke and metals, and possibly some unconverted alkali metal sulfide. The reaction occurs according to the following equation wherein A represents an alkali metal:

$$2ASH + H_2O + CO_2 \rightleftharpoons A_2CO_3 + 2H_2S \uparrow \quad (1)$$

The reaction is effected by treating the spent solids, which are in the form of a melt or slurry, at a temperature of from about 800°–1400° F., preferably from about 900°–1300° F., and most preferably from about 1000°–1200° F., and at a pressure of from about 0–1000 psig, and preferably at approximately atmospheric pressure, with a mixture of steam and carbon dioxide. Alternatively, the spent solids can first be dissolved in water, and then treated at from about 100°–400° F., preferably from about 100°–300° F., and most preferably from about 150°–250° F., and at a pressure of from about 0–1000 psig, and preferably from about 0–200 psig with sufficient carbon dioxide to convert about 35%–65% of the alkali metal hydrosulfide to an alkali metal carbonate, preferably about 40%–60% and most preferably about 50%. The product slurry which results from the carbonation step, or the dried product which results if the aqueous reaction route is used, comprises a mixture of alkali metal carbonate and alkali metal hydrosulfide. The mole ratio of the carbonate to the hydrosulfide will generally be about one-half, but will vary according to the amount of conversion resulting in the carbonation chamber. The slurry or dried product will also include coke which has been produced during hydroconversion. The conversion to the sulfide is effected by removing the slurry or dried product to a metathesis reactor wherein the mixture will be heated to from about 1200°–1800° F. at roughly atmospheric pressure. The mixture is introduced into the metathesis reactor either alone or with additional coke where necessary or desired.

The amount of additional coke will vary with the particular composition of the product slurry or dried product which resulted from the carbonation step. In this regard, it is undesirable to have any non-gasified coke returned to the hydroconversion reactor. This, therefore, establishes a maximum limit on the amount of coke to be present in metathesis. Specifically, the maximum carbon that can be gasified, assuming 100% conversion of $CO_2$ and $H_2O$ to CO and $H_2$, is roughly 8 grams of coke per 100 grams of KSH in the spent solids, or more generally 0.48 moles of carbon (coke) per mole of ASH. In practice, however, not all the $CO_2$ and $H_2O$ is converted (only about 70%–90%) so the optimum amount of coke will be about 80% of 0.48 or 0.38 moles of carbon per mole of ASH. Therefore, depending upon the yield of coke from the hydroconversion reactor, coke should or should not be added to achieve roughly this level.

The reaction between the hydrosulfide and the carbonate results in the liberation of steam and carbon dioxide. The liberated gases react with the coke present to form carbon monoxide and hydrogen. Completion of the metathesis reactions at the temperatures and pressures noted above requires from about 0.2–2 hours, and varies according to the particular composition of the mixture fed to the metathesis reactor as well as the amount of additional coke which might be added thereto.

The metathesis reactions take place according to the following equations:

$$2ASH + A_2CO_3 \rightleftarrows 2A_2S + CO_2 + H_2O \quad (2)$$

$$CO_2 + C \rightleftarrows 2CO \quad (3)$$

$$H_2O + C \rightleftarrows CO + H_2 \quad (4)$$

Reaction (2) will have a favorable equilibrium constant at the above noted temperatures. Additionally, conversion is further improved by the reaction of the product gases ($CO_2$ and $H_2O$) with the coke present in the slurry or melt. These gasification reactions (3) and (4) drive reaction (2) to near completion, and in the process usually consume most of the coke produced in the hydroconversion reactor.

The product remaining in the metathesis reactor which comprises the regenerated alkali metal sulfide plus metals still present from the original feed, can be directly recycled for use as a hydroconversion reagent. Where it is desired to minimize the amount of metals present in the regenerated sulfide, it is possible to first treat the spent solids from the hydroconversion reactor prior to their being removed to the carbonation chamber. Such removal can be effected by a small slipstream, where a portion of the spent solids from the hydroconversion reactor is either periodically or continuously withdrawn from the hydroconversion reaction zone and dissolved in water. The salts of these metals, primarily nickel and vanadium salts, are insoluble in water and can thus be easily separated from the soluble alkali metal sulfides. The separation can be effected in any conventional manner. If solution carbonation is used, part of the solution to or from the carbonation reactor can be filtered directly, if desired, to remove these metals.

DESCRIPTION OF THE PREFERRED EMBODIMENTS

A. Solution Carbonation of KSH

As a result of the mild temperatures which can be used to effect carbonation of the alkali metal hydrosulfide, solution carbonation is the preferred embodiment rather than resorting to a steam/$CO_2$ mixture which requires a higher energy input. To demonstrate the ease with which potassium hydrosulfide can be converted to potassium carbonate two runs were performed, each using a 0.25 liter aqueous solution of the hydrosulfide at 180° F. and atmospheric pressure. A carbon dioxide flow of 400 cc/min for a period of one hour was used to effect the reaction. The first run employed a 10 weight percent potassium hydrosulfide solution. Under the aforementioned conditions, the fraction of sulfur removed was found to be 95%. The moles of $H_2S$ evolved per mole of $CO_2$ consumed was 1.4. The second run employed a 25 weight percent potassium hydrosulfide solution which resulted in an 82% conversion of sulfur. The moles of $H_2S$ evolved per mole of $CO_2$ consumed was 1.8.

While the theoretical number of moles of $H_2S$ which are evolved per mole of $CO_2$ consumed equals 2 (see equation (1) above), the fact that in practice less $H_2S$ is evolved than expected indicates that a second alternative carbonation reaction exists to a limited extent. Such reaction is as follows:

$$KSH + H_2O + CO_2 \rightarrow KHCO_3 + H_2S$$

The bicarbonate ($KHCO_3$) is known to decompose to the carbonate at temperatures above about 200°–400° F.:

$$2KHCO_3 \rightarrow K_2CO_3 + H_2O + CO_2$$

Thus, any bicarbonate that is formed will decompose during the heat-up stage prior to the metathesis reactions. In any event, these results clearly indicate that the solution carbonation of the alkali metal hydrosulfide is a facile reaction and reaches high conversion levels at moderate temperatures and pressures.

B. Regeneration of $K_2S$ from KSH

To demonstrate the efficiency of the metathesis reactions (equations (2)–(4) above), five runs were conducted at temperatures ranging from 1200° F.–1750° F. Runs 1 through 3 utilized a mixture of 75 gm potassium hydrosulfide, 75 gm potassium carbonate, and 25 gm carbon-black, while runs 4 and 5 utilized 25 gm fluid coke in place of the carbon-black. All reactants were in solid form and in all runs, the mole ratio of hydrosulfide to carbonate to carbon was 2/1/4. Further, in each run the reagents were introduced into a 0.5 liter graphite tube reactor maintained at atmospheric pressure and the reactor flushed with a helium sweep gas at the rate of 1.8 liters per minute. It should be noted that although the experiments were run for 1–2 hours, in all cases the reaction was complete after only ½ hour, as detected by the time dependence of the production of gas.

As can readily be seen from Table I, the conversion to the alkali metal sulfide is temperature-dependent, reaching 50%–60% at 1500° F. and 90% at 1700° F. The major off gas of the conversion is carbon monoxide. Side reactions involving oxidation of the sulfide to higher oxidation states (e.g., $K_2SO_3$ and $K_2SO_4$ which are inactive for hydroconversion), as shown in the Table, are not prominent. The values for $SO_3^=$, for Experiments 2 and 3, are abnormally high due to oxidation of $S^=$ during analysis.

C. Hydroconversion with Potassium Sulfide

The potassium sulfide produced as a result of the above disclosed regeneration can be recycled to the hydroconversion reactor together with any uncovered potassium hydrosulfide and potassium carbonate. The recycled product exhibits substantially equivalent activity during the hydroconversion process as potassium sulfide formed by conventional means.

Table II gives the results of a hydroconversion process conducted using conventionally prepared potassium sulfide. Table III gives the results of a hydroconversion process conducted using potassium sulfide which has been regenerated from potassium hydrosulfide according to the process of this invention. Hydroconversion conditions in both instances were the same, the feedstock employed being Safaniya Residuum introduced into a 3-liter autoclave, together with 2000 SCF/B $H_2$, to achieve a pressure within the autoclave of 2000 psig, the reactor being maintained at a temperature of 750° F. and the time of reaction with the potassium sulfide being 1 hour. In both instances, the potassium sulfide was in powder form.

The results clearly demonstrate the effectiveness of potassium sulfide as a hydroconversion reagent, as well as the substantial equivalence for this purpose of potassium sulfide produced according to the process of this invention. In any event, while the invention has been described with a certain degree of particularity, it will be understood that the description was by way of example only and that numerous variations and modifications, as may become apparent to those of ordinary skill in the art, can be made without departing from the spirit and the scope of the invention as hereinafter claimed.

TABLE I

| Run No. | 1 | 2 | 3 | 4 | 5 |
|---|---|---|---|---|---|
| Temperature, ° F. | 1200 | 1500 | 1750 | 1500 | 1700 |
| Time (hr) | 2 | 2 | 2 | 2 | 1 |
| Conversion, Mole %* | 10 | 51 | 91 | 65 | 97 |
| Off-Gas Analysis, Weight % of Charge | | | | | |
| $H_2O$ | 0.5 | 0.4 | 0.1 | 1.3 | 1.0 |
| $H_2S$ | — | — | — | Trace | — |
| CO | 0.5 | 11.1 | 19.9 | 10.8 | 16.5 |
| $CO_2$ | 1.0 | 1.5 | 2.3 | 3.4 | 3.5 |
| $H_2$ | Trace | 0.1 | 0.2 | 0.1 | 0.1 |
| Sulfur Analysis, Weight % S In Each Oxidation State | | | | | |
| $S^=$ | — | 67 | 62 | — | 95 |
| $S^o$ | — | 9 | 7 | — | n.a. |
| $SO_3^=$ | — | 22 | 29 | — | 5 |
| $SO_4^=$ | — | 1 | 1 | — | — |

*Conversion = fraction of KSH reacted × 100%

TABLE II

| | |
|---|---|
| Weight % Reagent on Feed ($K_2S$) | 15 |
| Product Yields, Weight % | |
| $H_2S$ | 2.2 |
| $C_1/C_4$ Gas | 1.4 |
| $C_5$+ Liquid | 96.3 |
| Coke | 0.1 |
| $C_5$+ Liquid Inspections | |
| S, Weight % | 2.1 |
| CCR, Weight % | 8.7 |
| Ni/V, ppm | 8/26 |
| Desulfurization, % | 52 |
| Demetallization, % | 73 |
| CCR Conversion to Distillate, % | 35 |

TABLE III

| | |
|---|---|
| Weight % Reagent on Feed ($K_2S/KSH/K_2CO_3$) | 12/4/4 |
| Product Yields, Weight % | |
| $H_2S$ | 2.3 |
| $C_1/C_4$ Gas | 0.6 |
| C + Liquid | 97.1 |
| Coke | 0.0 |
| $C_5$+ Liquid Inspections | |
| S, Weight % | 2.1 |
| CCR, Weight % | 8.5 |
| Ni/V, ppm | 9/3 |
| Desulfurization, % | 51 |
| Demetallization, % | 90 |
| CCR Conversion to Distillate, % | 37 |

What is claimed is:

1. A process for the conversion of an alkali metal hydrosulfide to an alkali metal sulfide, which comprises contacting alkali metal hydrosulfide, produced during the hydroconversion of a heavy carbonaceous feedstock by contact of said feedstock with an alkali metal sulfide, with water and carbon dioxide at a temperature and pressure sufficient to convert about 50% of said alkali metal hydrosulfide to an alkali metal carbonate, and heating a mixture of said alkali metal carbonate, unreacted alkali metal hydrosulfide, and coke to an elevated temperature sufficient to cause reaction of the alkali metal hydrosulfide with the alkali metal carbonate whereby an alkali metal sulfide is formed.

2. The process of claim 1 wherein the mixture of said alkali metal carbonate, unreacted alkali metal hydrosulfide, and coke is heated to a temperature of from about 1200°–1800° F.

3. The process of claim 1 wherein the alkali metal of said alkali metal hydrosulfide, said alkali metal carbonate, and said alkali metal sulfide comprises an alkali metal selected from the group consisting of sodium, lithium, potassium, rubidium, cesium, and mixtures thereof.

4. The process of claim 1 wherein said alkali metal of said alkali metal hydrosulfide, said alkali metal carbonate, and said alkali metal sulfide comprises potassium.

5. The process of claim 1 wherein said water is in the form of steam and further wherein said temperature and pressure sufficient to convert about 50% of said alkali metal hydrosulfide to said alkali metal carbonate comprises a temperature of from about 800°–1400° F. and atmospheric pressure.

6. The process of claim 1 wherein said alkali metal hydrosulfide is dissolved in water to form an aqueous solution, and further wherein said temperature and pressure sufficient to cause conversion of about 50% of said alkali metal hydrosulfide to said alkali metal carbonate comprises a temperature of from about 100°–400° F. and a pressure of from about 0–1000 psig.

7. The process of claim 1 wherein additional coke is added to the mixture of said alkali metal carbonate, alkali metal hydrosulfide, and coke prior to heating.

8. The process of claim 1 wherein said alkali metal sulfide which has been regenerated from said alkali metal hydrosulfide is recycled to a hydroconversion reactor for use as a hydroconversion reagent.

9. A process for the hydroconversion of a heavy carbonaceous feedstock by contact of said feedstock with an alkali metal sulfide and regeneration of an alkali metal sulfide from an alkali metal hydrosulfide produced as a result of said hydroconversion which comprises: contacting a heavy carbonaceous feedstock with an alkali metal sulfide in a reaction zone under conditions sufficient to effect hydroconversion of said feedstock; removing spent solids from said reaction zone to a carbonation chamber, said solids comprising primarily an alkali metal hydrosulfide, coke, metals and unconverted alkali metal sulfide; contacting said spent solids with water and carbon dioxide at a temperature and pressure sufficient to convert about 50% of said alkali metal hydrosulfide to an alkali metal carbonate; heating a mixture of said alkali metal carbonate, unreacted alkali metal hydrosulfide, and coke produced during said hydroconversion to an elevated temperature sufficient to cause reaction of the alkali metal hydrosulfide with the alkali metal carbonate whereby an alkali metal sulfide is formed.

10. The process of claim 9 wherein the mixture of said alkali metal carbonate, unreacted alkali metal hydrosulfide, and coke is heated to a temperature of from about 1200°-1800° F.

11. The process of claim 9 wherein the alkali metal of said alkali metal hydrosulfide, said alkali metal carbonate, and said alkali metal sulfide comprises an alkali metal selected from the group consisting of sodium, lithium, potassium, rubidium, cesium, and mixtures thereof.

12. The process of claim 9 wherein said alkali metal of said alkali metal hydrosulfide, said alkali metal carbonate, and said alkali metal sulfide comprises potassium.

13. The process of claim 9 wherein said water is in the form of steam, and further wherein said temperature and pressure sufficient to convert about 50% of said alkali metal hydrosulfide to said alkali metal carbonate comprises a temperature of from about 800°-1400° F. and atmospheric pressure.

14. The process of claim 9 wherein said spent solids are dissolved in water to form an aqueous solution, and further wherein said temperature and pressure sufficient to convert about 50% of said alkali metal hydrosulfide to said alkali metal carbonate comprises a temperature of from about 100°-400° F. and a pressure of from 0-1000 psig.

15. The process of claim 13 wherein the level of impurity metals present in the regenerated alkali metal sulfide is reduced by removing at least a portion of said spent solids from said reaction zone, dissolving said solids in water to form a solution, and filtering said solution to remove metals.

16. The process of claim 14 wherein said aqueous solution is filtered to remove metals therefrom.

17. The process of claim 9 wherein said alkali metal sulfide which has been regenerated from said alkali metal hydrosulfide is recycled to said reaction zone for further hydroconversion of said heavy carbonaceous feedstock.

18. The process of claim 9 wherein additional coke is added to the mixture of said alkali metal carbonate, said alkali metal hydrosulfide, and coke prior to heating.

19. The process of claim 9 wherein the level of metals in said spent solids is reduced prior to further processing.

* * * * *